US006311370B1

(12) United States Patent
Blin

(10) Patent No.: US 6,311,370 B1
(45) Date of Patent: Nov. 6, 2001

(54) SKIPOLE HANDLE EQUIPPED WITH A SAFETY STRAP

(75) Inventor: Christophe Jacques Marie Blin, Enghien (FR)

(73) Assignee: Skis Rossignol S.A., Voiron (FR)

( * ) Notice: Subject to any disclaimer, the term of this patent is extended or adjusted under 35 U.S.C. 154(b) by 0 days.

(21) Appl. No.: 09/549,979

(22) Filed: Apr. 14, 2000

(30) Foreign Application Priority Data

Apr. 23, 1999 (FR) ..... 99 05402

(51) Int. Cl.[7] ..... A63C 11/00
(52) U.S. Cl. ..... 16/436; 16/421; 280/821
(58) Field of Search ..... 16/436, 421, 143; 280/819, 821, 822, 823

(56) References Cited

U.S. PATENT DOCUMENTS

| | | | | |
|---|---|---|---|---|
| 3,982,747 | * | 9/1976 | Schweinsberg | 280/11.37 H |
| 4,247,132 | * | 1/1981 | Shields | 280/814 |
| 4,288,100 | * | 9/1981 | Aho | 280/821 |
| 4,779,896 | * | 10/1988 | Ingalls | 280/821 |
| 5,632,061 | * | 5/1997 | Smith et al. | 16/110 R |
| 6,139,060 | * | 10/2000 | Lenhart | 280/821 |

FOREIGN PATENT DOCUMENTS

| | | | |
|---|---|---|---|
| 2352600 | * | 10/1973 | (CH) . |
| 23 52 600 | | 4/1975 | (DE) . |
| 2828612 | * | 6/1978 | (DE) . |
| 26 56 814 | | 6/1978 | (DE) . |
| 28 28 612 A | | 1/1980 | (DE) . |
| 28 08 549 | | 10/1989 | (DE) . |
| 40 05 193 A | | 8/1991 | (DE) . |
| 2 270 913 A | | 12/1975 | (FR) . |
| 2382250 | * | 3/1977 | (FR) . |

OTHER PUBLICATIONS

Preliminary Search Report in SN Fr 9905402.

* cited by examiner

*Primary Examiner*—Anthony Knight
*Assistant Examiner*—Mark Williams
(74) *Attorney, Agent, or Firm*—Bugnion S.A.; John Moetteli

(57) ABSTRACT

A pole handle (1) equipped with a safety strap (3) having a connecting piece (11) fixed by snap-fastening into a housing in the handle so as to detach under the effect of a tensile force and which can be reattached to the handle repeatedly. The connecting piece (11) is held in the handle by a pair of projections (7, 8) and can detach from the handle by elastically deforming the projections under the effect of a tensile force directed at least approximiately along the axis of the pole.

12 Claims, 4 Drawing Sheets

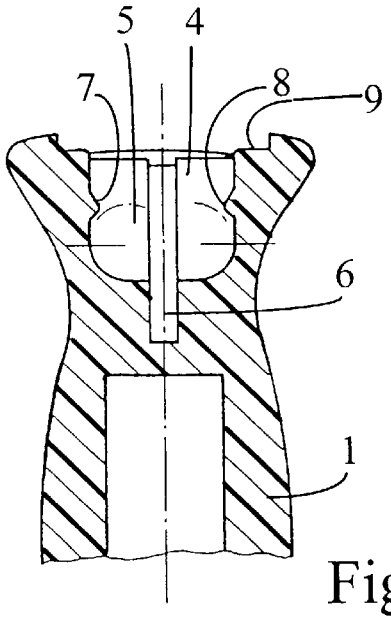
Fig.5
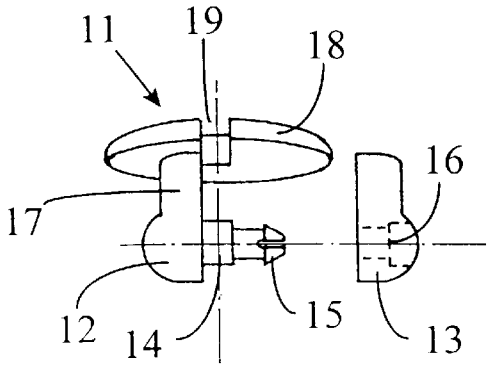
Fig.6
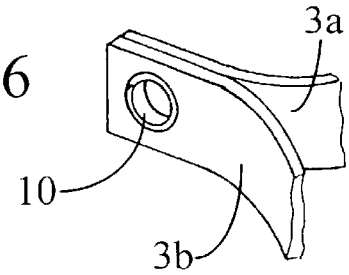
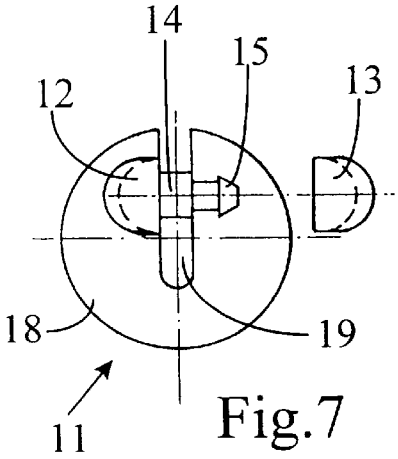
Fig.7
Fig.8
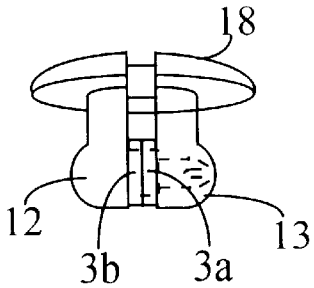

Fig.10
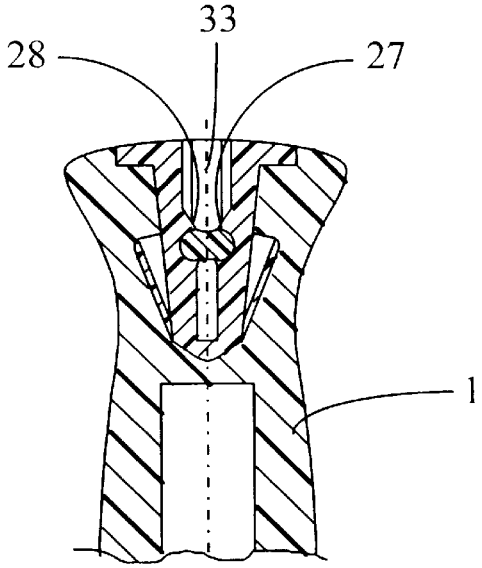
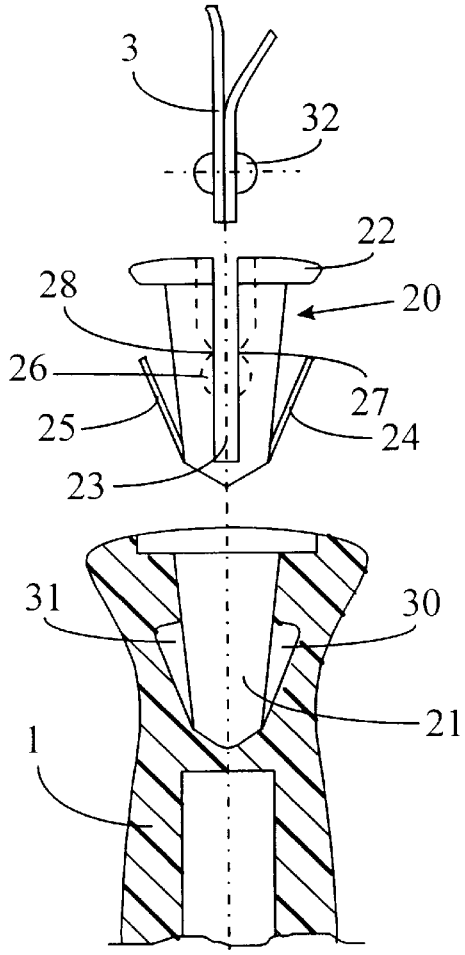
Fig.9
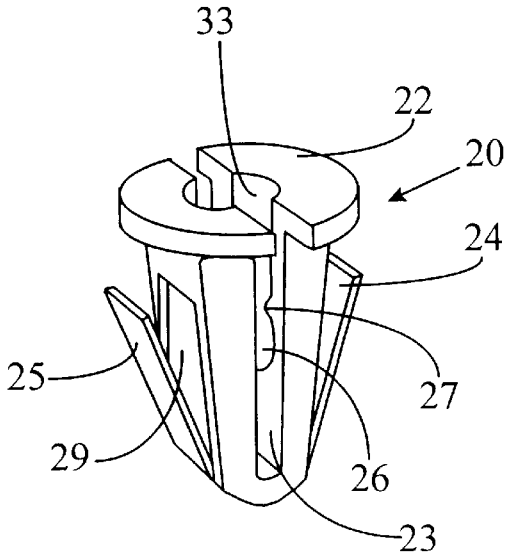
Fig.11

SKIPOLE HANDLE EQUIPPED WITH A SAFETY STRAP

BACKGROUND OF THE INVENTION

The present invention relates to a ski pole handle equipped with a safety strap consisting of a strip formed into a loop equipped with a connecting piece fixed by snap-fastening into a housing formed in the upper part of the handle so that it detaches from the handle by elastic deformation of the snap fastening under the effect of a tensile force which exceeds a predetermined value so that it can be reattached to the handle repeatedly.

A handle of this kind is known from patent DE 28 08 549, the content of which is incorporated by reference. The connecting piece consists of an elastic clip which is snap-fastened over a transverse metallic bar belonging to the handle. The two lengths of the strip which form the strap are fixed flat by means of a rivet in a slit in the connecting piece. The strap can detach from the handle both under the effect of a tensile force directed transversely to the handle and under the effect of a tensile force directed along the axis of the pole.

Patent application DE 26 56 814, the content of which is incorporated by reference, also discloses a ski pole handle equipped with a safety ski strap equipped with a bent metal connecting piece exhibiting a thickened portion in the shape of a dihedron which engages under a corresponding bent part of a spring leaf anchored in the bottom of a housing opening laterally to the side of the handle and pressing against an abutment screw which allows the release force to be adjusted. This construction is relatively complicated and the adjusting screw is liable to become unscrewed altering the setting. The strap can detach from the handle both under the effect of a lateral tensile force and under the effect of a tensile force parallel to the axis of the handle, the lateral tensile force needed for detachment however being greater than the longitudinal tensile force.

Patent application DE 23 52 600, the content of which is incorporated by reference, describes safety handles which detach from the pole under the effect of a tensile force directed in the continuation of the pole. This same document proposes a safety strap held axially in the handle of a pole by a pawl, the rounded snout of which engages directly in the material of the strap. In the normal position of use, the strap presses against one arm of the pawl so as to prevent the latter from tilting to release itself from the strap. The direction of the detachment force is therefore also selective. This construction is, however, relatively complicated and fragile, the pawl furthermore having to have a spring to prevent the strap from escaping while it is being introduced and when the pole is hung up by its strap. Furthermore a rigid connecting piece between the strap and the pawl is needed in practice.

In general, it has become apparent that strap detachment under the effect of a tensile force transversal to the handle is not needed, or even undesirable.

SUMMARY OF THE INVENTION

The object of the invention is to fix a safety strap to a pole handle using means which are simpler than the means known from the prior art, which is highly robust, but which detaches from the pole only under the effect of a tensile force directed at least approximately in the continuation of the handle, and in which the strap has a more favorable position of use.

The ski pole handle according to the invention is one wherein the housing in the handle has a cavity which is bounded in the direction of the upper end of the handle by a pair of projections and wherein the housing communicates laterally with the outside of the handle via a slot, and wherein the connecting piece has a shape such that it can be forcibly axially introduced into said cavity and held in the cavity by the pair of projections in a position such that the strap passes through said slot and can turn about an axis transversal to the handle and can detach from the handle under the effect of a tensile force directed at least approximately in the continuation of the handle.

This handle is of a very simple construction. The fixing of the strap to the handle involves neither pin nor spring nor pawl. The connecting piece is fixed directly into the cavity of the housing in the handle. The strap is easy to refit. All that is required is for the connecting piece to be pushed into the housing in the handle.

According to one embodiment the strap is articulated to the connecting piece and the latter is advantageously equipped with a flange which closes off the housing in the handle, it being on this flange that the pressure is exerted for refitting the strap.

The slot is advantageously directed parallel to the longitudinal axis of the handle and its width is approximately equal to the thickness of the strip of the strap and is then oriented in this way in a vertical plane.

The strap can turn about an axis transversal to the handle, which gives it a great deal of freedom of movement. The vertical position of the lengths of the strap in the handle seems more favorable than the customary flat position.

This connecting piece is advantageously made of plastic and is made up of two parts joined together so that they cannot be disassembled, by snap-fastening, one of the parts having a pin passing through the strap and a split conical head which catches in the second part of the connecting piece.

According to one embodiment, the housing is located in an attached plastic component which has two lateral catching tabs capable of flexing elastically when the attached component is introduced axially into the handle so as to catch in the handle. Advantageously, said slot extends diametrically across the attached component and also acts as an elasticity slot ensuring that the attached component is held in the handle without play.

BRIEF DESCRIPTION OF THE DRAWINGS

The appended drawing depicts, by way of example, one embodiment of the invention.

FIG. 5 is a view in section on V—V of FIG. 4.

FIG. 6 is an exploded view of the strap and of its connecting piece.

FIG. 7 is a view from beneath of the connecting piece prior to the joining-together of the two parts of this piece.

FIG. 8 is a perspective view of the assembled connecting piece.

FIG. 9 is an exploded view, in partial cross section, of a second embodiment.

FIG. 10 is a view in axial section of the second embodiment, assembled.

FIG. 11 is a perspective view of the attached component of FIGS. 9 and 10.

DETAILED DESCRIPTION OF THE PREFERRED EMBODIMENT(s)

Figure 1:
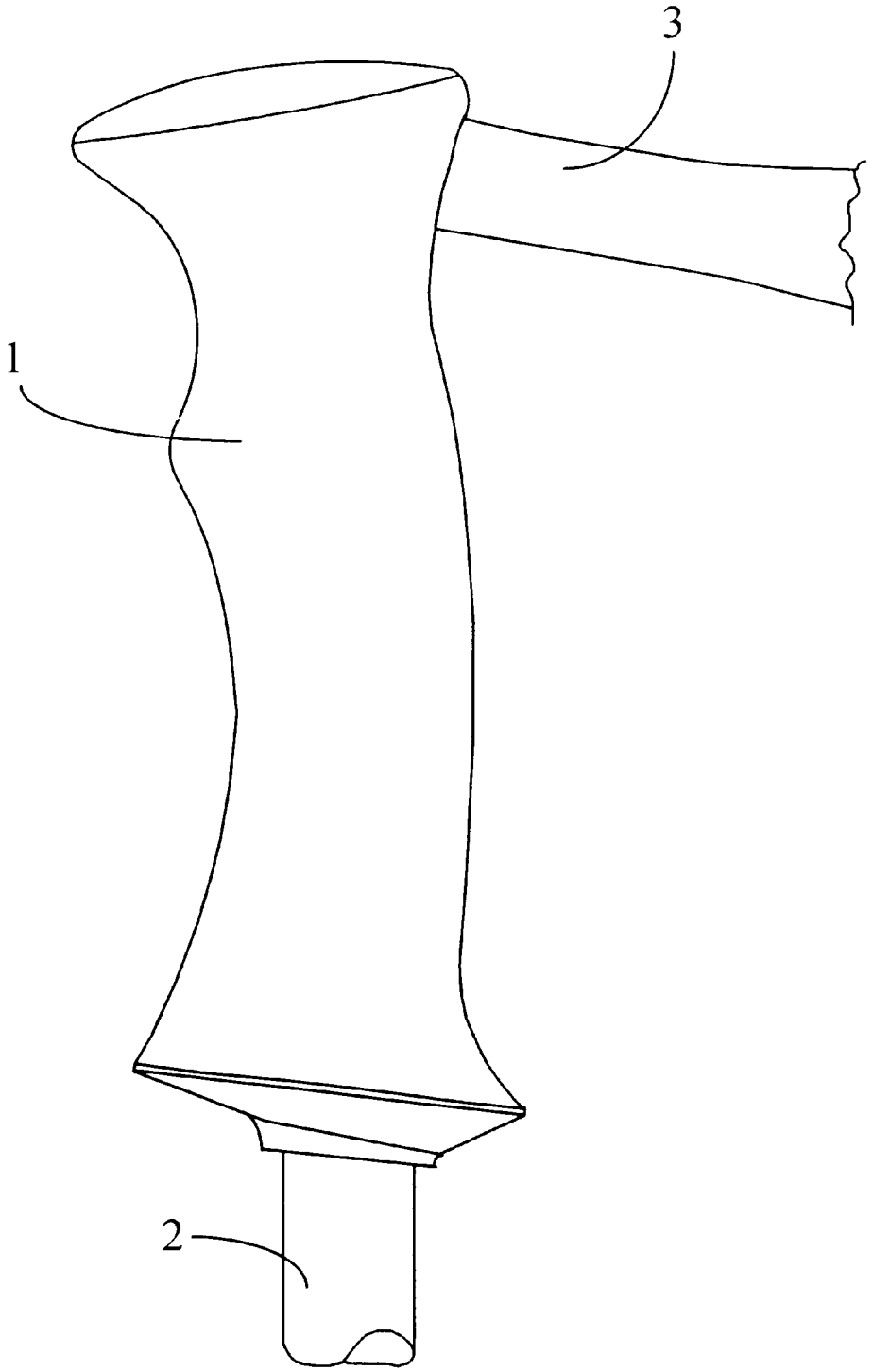
FIG. 1 is a side view of a ski pole handle with its strap partially depicted.

FIG. 1 shows a plastic handle 1 fixed to the end of a ski pole 2 and equipped with a strap 3.

The upper end of the handle 1 has a housing 4, the lower part of which forms a cavity 5 extending on each side of an axial slot 6 extending over slightly more than half of the diameter of the handle and opening laterally to the side of the handle. The cavity 5 is bounded toward the top by two projections 7 and 8 arranged symmetrically with respect to the slot 6. At the end of the pole, the housing 4 opens to a counterbore 9.

The strap 3 consists of a strip or tape, the two lengths 3*a* and 3*b* of which are fixed by means of an eyelet 10 (FIG. 6) to form a loop. The strap 3 is connected to the handle 1 by a plastic connecting piece 11. This connecting piece is made up of two parts 12 and 13. The part 12 is equipped with a stub of a pin 14 with a diameter corresponding to the diameter of the eyelet 10 and which is intended to pass through this eyelet, and of a rod with a split conical head 15, intended to snap fasten into a housing 16 in the part 13. Once assembled to the strap, the two parts 12 and 13 form a part, the shape of which mates to that of the cavity 5 in which it is held by the projections 7 and 8. The part 12 has a stalk 17 secured to a flange 18 equipped with a slit 19. The part 13 is identical and symmetrical to the part 12, without the protrusions 14 and 15. When the connecting part 11 is fixed to the strap, its two parts 12 and 13 face each other via plane parallel faces which coincide respectively with the sides of the slit 19 so that the strap can turn about the pin 14 while engaged freely in the slit 19.

To flix the strap 3 to the handle 1 all that is required is for the connecting piece 11 to be pushed into the housing 4 by exerting pressure on the flange 18, which pressure pushes it down under the projections 7 and 8 by elastic deformation of the material of the pole. The shape of the entry to the housing 4 positions and guides the connecting piece during this assembly operation. The strap itself automatically engages in the slot 6. The flange 18 fits into the counterbore 9, closing the housing 4 and ensuring the continuity of the upper face of the pole.

Figure 2:
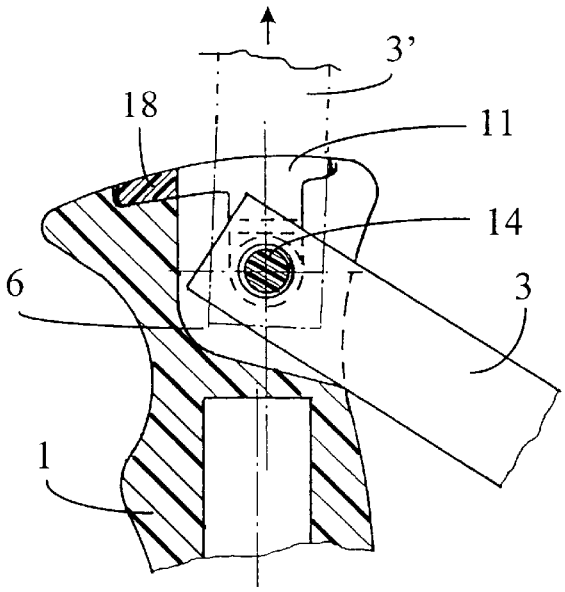
FIG. 2 is a view in axial section of the upper part of the handle depicted in FIG. 1.
Figure 3:
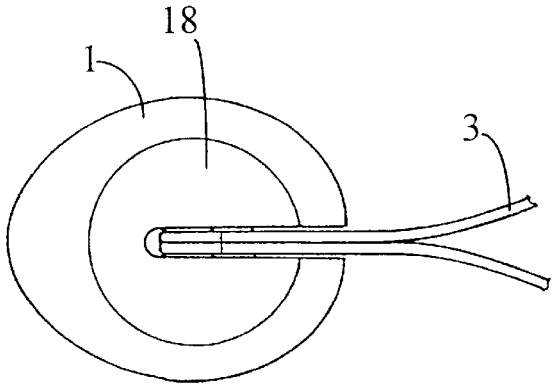
FIG. 3 is a view from above of the handle depicted in FIG. 1.
Figure 4:
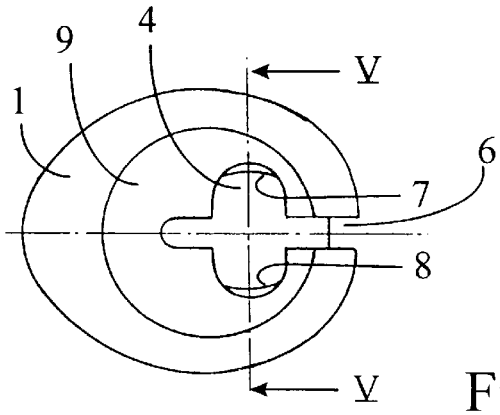
FIG. 4 is also a view from above, but without the strap.

When the strap 3 emerges laterally from the handle 1, as is the case in FIGS. 1 and 2, it cannot be detached from the handle 1 by tension.

By contrast, when the strap 3 is in the position 3' depicted in phantom line in FIG. 2, that is to say in the continuation of the pole, which is what happens when the pole remains stuck in the snow or caught on an obstacle, the tension exerted on the strap has the effect of detaching the connecting piece 11 from the handle by elastic deformation of the handle.

The free articulation of the strap about a pin transversal to the handle gives it great freedom of movement. This, combined with the position of the lengths of the strap as they emerge from the handle, contributes to improving the comfort of use.

The embodiment described could be further simplified by directly overmolding a connecting piece onto the strap. In this case, the shape of the connecting piece and the shape of the cavity in the handle are such that the connecting piece can turn in the cavity about a geometric axis perpendicular to the longitudinal axis of the handle.

In general, the cavity in which the connecting piece is held does not necessarily have to have a shape that mates to that of the connecting piece; it is sufficient that the connecting piece be held in the cavity.

The invention also applies to a strap oriented in the conventional way relative to the handle.

In the second embodiment depicted in FIGS. 9 to 11 the strap 3 is connected to the handle 1 by an attached plastic component 20. This component 20 is inserted in a housing 21 in the handle 1.

The component 20, of rectangular cross section, is equipped at its upper end with a flange 22 which is divided into two by a slot 23 extending axially over most of the height of the component 20 and forming a housing 33. On each side the component 20 has a lateral tab 24, 25, respectively diverging obliquely upward from the lower end of the component 20. The housing 33 comprises a cavity 26 corresponding to the cavity 5 of the first embodiment, this cavity being bounded toward the top by two opposed projections 27 and 28 corresponding to the projections 7 and 8 of the first embodiment. The housing 21 in the handle also has an essentially rectangular cross section, the width of which is slightly smaller than the width of the component 20 measured transversely to the slot 23. Furthermore, the cross section of the component 20 and the cross section of the cavity 21 in the handle decrease slightly downward. As the component 20 is inserted into the handle, the slot 23 acts as an elasticity slot, allowing, the slot 23 to close up slightly. During this insertion, the flexible tabs 24 and 25 bend in housings such as 29 in the component 20 and retract into these housings. When the component 20 is completely inserted into the handle 1, the tabs 24 and 25 move apart to catch in housings 30 and 31 in the handle.

The strap 3 is equipped with a one-piece connecting piece 32 forcibly introduced into the hole 10 in the strap and is equipped with a central groove in which the strap is engaged.

The connecting piece 32 is forcibly inserted into the component 20 or overmolded onto the strap, as in the previous embodiment.

This embodiment has the advantage of allowing the use of different materials for the handle 1 and for the component 20, it being possible for the material of the handle 1 to be more rigid than the material of the component 20 which has to allow the connecting piece 30 to escape by elastic deformation of the projections 27 and 28.

Although illustrative embodiments of the invention have been shown and described a wide range of modification, change, and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed is:

1. A ski pole handle having a long axis around which the handle is gripped, the handle equipped with a safety strap (3) consisting of a strip formed into a loop equipped with a connecting piece (11; 32) fixed by snap-fastening into a housing (4; 33) formed in the upper part of the handle (1) so that it detaches from the handle by elastic deformation of the snap fastening under the effect of a tensile force which exceeds a predetermined value and so that it can be reattached to the handle repeatedly, wherein the housing (4; 33) in the handle has a cavity (5; 26) which is bounded in the direction of the end of the handle by a pair of opposed projections (7, 8; 27, 28) and wherein the housing communicates laterally with the outside of the halidle via a slot (6;

23), and wherein the connecting piece (11; 32) has a shape such that it can be forcibly axially introduced into said cavity and held in this cavity by said projections (7, 8; 27, 28) in a position such that the strap passes through said slot (6; 23) and can turn about an axis transverse to the long axis of the handle and can detach from the handle under the effect of a tensile force directed at least approximately along the axis of the pole.

2. The handle as claimed in claim 1, wherein said slot (6; 23) is directed parallel to the longitudinal axis of the handle and wherein its width is approximately equal to twice the thickness of the strip of the strap.

3. The handle as claimed in claim 2, wherein the strap (3) is articulated to the connecting piece (11; 32).

4. The handle as claimed in claim 3, wherein the connecting piece has a pin (14) passing through an eyelet (10) in the strap.

5. The handle as claimed in claim 3, wherein the connecting piece (11), made of plastic, is made up of two parts (12, 13) joined together so that they cannot be disassembled by snap-fastening.

6. The handle as claimed in claim 5, wherein the connecting piece has a pin (14) passing; through an eyelet (10) in the strap.

7. The handle as claimed in one of claims 2 to 6, wherein the connecting piece (11) has a flange (18) closing off the housing in the handle except for a slit (19) formed in the flange and coinciding with the slot (6) in the handle so as to allow the strap to engage in the slit and be directed in the continuation of the handle.

8. The handle as claimed in claim 7, wherein the connecting piece is overmolded onto the strap.

9. The handle as claimed in claim 2, wherein the shape of the cavity (5; 26) of the handle and the shape of the connecting piece (11; 32) are such that the connecting piece can turn in the cavity about an axis perpendicular to the longitudinal axis ofthe handle.

10. The handle as claimed in claim 1, wherein the cavity (26) is located in an attached plastic component (20).

11. The handle as claimed in claim 10, wherein the attached component (20) has two lateral catching tabs (24, 25) capable of flexing elastically when the attached component is introduced axially into the handle so as to catch in the handle.

12. The handle as claimed in claim 11, wherein said slot (23) extends diametrically across the attached component (20) and also acts as an elasticity slot ensuring that the attached component is held in the handle without play.

* * * * *